US011355854B2

(12) United States Patent
Daniel et al.

(10) Patent No.: US 11,355,854 B2
(45) Date of Patent: Jun. 7, 2022

(54) METHOD AND APPARATUS FOR REACTANCE CONTROL IN A TRANSMISSION LINE

(71) Applicant: Metawave Corporation, Palo Alto, CA (US)

(72) Inventors: George Daniel, Palo Alto, CA (US); Maha Achour, Palo Alto, CA (US)

( * ) Notice: Subject to any disclaimer, the term of this patent is extended or adjusted under 35 U.S.C. 154(b) by 552 days.

(21) Appl. No.: 16/201,990

(22) Filed: Nov. 27, 2018

(65) Prior Publication Data

US 2019/0165480 A1 May 30, 2019

Related U.S. Application Data

(60) Provisional application No. 62/594,019, filed on Dec. 4, 2017, provisional application No. 62/591,171, filed on Nov. 27, 2017.

(51) Int. Cl.

| | |
|---|---|
| ***H01Q 13/10*** | (2006.01) |
| ***H01Q 13/20*** | (2006.01) |
| ***H01Q 5/364*** | (2015.01) |
| ***H01P 5/18*** | (2006.01) |
| ***H01Q 3/36*** | (2006.01) |
| ***H01Q 21/06*** | (2006.01) |

(52) U.S. Cl.

CPC ..... *H01Q 13/103* (2013.01); *H01P 5/184* (2013.01); *H01Q 3/36* (2013.01); *H01Q 5/364* (2015.01); *H01Q 13/10* (2013.01); *H01Q 13/106* (2013.01); *H01Q 13/20* (2013.01); *H01Q 21/064* (2013.01)

(58) Field of Classification Search

CPC ..... H01Q 13/103; H01Q 3/36; H01Q 21/064; H01Q 13/10; H01Q 13/20; H01Q 5/364; H01Q 13/106; H01P 5/184

See application file for complete search history.

(56) References Cited

U.S. PATENT DOCUMENTS 8,633,866 B2 1/2014 Sarabandi et al.
9,545,923 B2 1/2017 Casse et al.
(Continued)

OTHER PUBLICATIONS

C. Balanis, et al. ,"Smart Antennas," in Introduction to Smart Antennas, 1st ed., San Rafael, CA, USA: Morgan & Claypool Publishers, ch. 4, pp. 33-67, 2007.
(Continued)

*Primary Examiner* — Dimary S Lopez Cruz
*Assistant Examiner* — Michael M Bouizza
(74) *Attorney, Agent, or Firm* — Sandra Lynn Godsey

(57) ABSTRACT

Examples disclosed herein relate to methods and apparatuses for a radiating structure to radiate a transmission signal, where the radiating structure incorporates reactance control elements to change a reactance of transmission lines and/or radiating unit cell elements, and a resonant coupler to isolate the transmission signal from a reactance control signal to the reactance control elements. A reactance control signal, such as a bias voltage, controls the reactance of transmission lines of the transmission array structure and/or the radiating unit cell elements so as to change the phase of the transmission signal, thereby steering a beam of the transmission signal. The reactance control elements may be incorporated into a microstrip within the transmission lines.

16 Claims, 8 Drawing Sheets

(56) References Cited

U.S. PATENT DOCUMENTS

| | | | | |
|---|---|---|---|---|
| 10,998,628 | B2 * | 5/2021 | Chen | H01Q 11/02 |
| 2007/0176827 | A1 * | 8/2007 | Itoh | H01Q 21/08 343/700 MS |
| 2015/0318618 | A1 * | 11/2015 | Chen | H01Q 9/0442 343/750 |
| 2018/0351250 | A1 * | 12/2018 | Achour | H01Q 13/10 |

OTHER PUBLICATIONS

F. Yang, et al., "Novel Phased Array Designs Using Reconfigurable Refection and Transmission Surfaces," in IEEE International Symposium on Antennas and Propagation and USNC-URSI Radio Science Meeting, Boston, MA, Jul. 2018, pp. 2973.

* cited by examiner

METHOD AND APPARATUS FOR REACTANCE CONTROL IN A TRANSMISSION LINE

CROSS REFERENCE TO RELATED APPLICATIONS

This application claims priority to, and the benefit of, U.S. Provisional Patent Application No. 62/591,171, filed on Nov. 27, 2017, and U.S. Provisional Patent Application No. 62/594,019, filed on Dec. 4, 2017, the entire disclosures of which are expressly incorporated by reference herein.

FIELD

The present disclosure relates to transmission systems, and specifically to lattice radiating structures with feed structures.

BACKGROUND

Many transmission systems, such as wireless systems, incorporate feed structures that guide an input signal to a variety of paths. These paths often involve changes in the transmission line type or function. These transitions introduce requirements for issues that may impact performance, including impedance matching between different portions (e.g., impedance matching different feed paths, impedance matching different transmission lines, etc.) of the feed structure, isolation of the transmission signals from other signals within the structure, and so forth. These may be solved in a variety of ways depending on the application, configuration, and materials used.

DRAWINGS

These and other features, aspects, and advantages of the present disclosure will become better understood with regard to the following description, appended claims, and accompanying drawings, which are not drawn to scale and in which like reference characters refer to like parts throughout, and where:

DESCRIPTION

Figure 1:
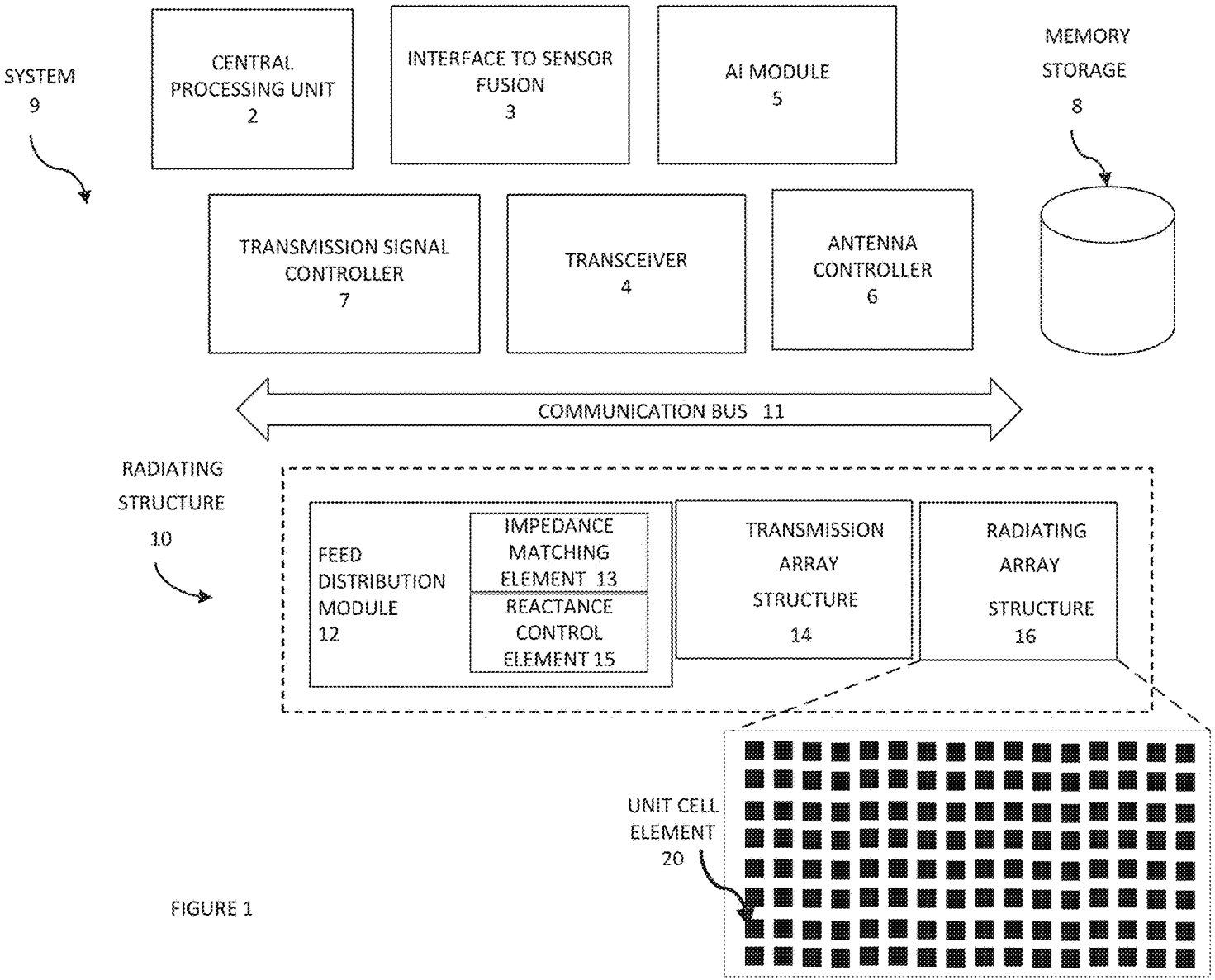
FIG. 1 illustrates an antenna system, according to examples of the present disclosure.

The present disclosure relates to methods and apparatuses for reactance control in a transmission line. In one or more examples, a radiating structure comprises a plurality of transmission lines to transmit at least one transmission signal, where each of the transmission lines comprises a plurality of slots. The radiating structure further comprises at least one reactance control element, which is coupled to at least one of the transmission lines, to change a reactance of at least one of the transmission lines. Also, the radiating structure comprises at least one resonant coupler to isolate at least one of the transmission signals from at least one reactance control signal, which controls at least one of the reactance control elements. Further, the radiating structure comprises a plurality of unit cell elements to radiate at least one transmission signal, where the unit cell elements are mounted proximate the slots of the transmission lines such that each of the slots is associated with one of the unit cell elements.

The examples of the present disclosure described herein provide for control of reactance, phase, and signal strength in a transmission line, a power divider circuit, and so forth. The control circuit includes a reactance control element, or reactance controller, such as a variable capacitor, to change the reactance of a transmission circuit and thereby control the characteristics of the signal propagating through the transmission line. In some examples, the reactance controller is a varactor that changes the phase of a signal. In other examples, alternate control mechanisms are used.

For structures incorporating a dielectric substrate to form a transmission path, such as a substrate integrated waveguide (SIW), the reactance control element may be integrated into the transmission line by inserting a microstrip or strip line portion that will support the reactance control elements. Where there is such an interruption in the transmission line, a transition is made to maintain signal flow in the same direction. Similarly, the reactance control element may require a reactance control signal, such as a direct current (DC) bias line or other control means, to enable the system to control and adjust the reactance of the transmission line. To isolate the reactance control signal from the transmission signal, examples of the present disclosure include a resonant coupler that acts to isolate the reactance control signal from the transmission signal. In the case of an antenna radiating array structure, the resonant coupler isolates the DC reactance control signal from the alternating current (AC) transmission signal.

The examples of the present disclosure are applicable in wireless communication and radar applications, and in particular, in some metamaterial (MTM) structures capable of manipulating electromagnetic (EM) waves using engineered radiating structures. Additionally, the examples of the present disclosure provide methods and apparatuses for generating wireless signals, such as radar signals, having improved directivity and reduced undesired radiation pattern aspects, such as side lobes. The examples of the present disclosure provide antennas with unprecedented capability of generating radio frequency (RF) waves for radar systems.

These examples provide improved sensor capability and support autonomous driving by providing one of the sensors used for object detection.

The examples of the present disclosure provide smart active antennas with unprecedented capability of manipulating RF waves to scan an entire environment in a fraction of the time of current systems. The examples of the present disclosure provide smart beam steering and beamforming using MTM radiating unit cell elements in a variety of configurations, where electrical changes to the antenna are used to achieve phase shifting and adjustment, thereby reducing the complexity and processing time, and enabling fast scans of up to approximately 360 degrees (°) field of view for long range object detection.

The examples of the present disclosure support a transmission array structure having a plurality of transmission lines configured with discontinuities (e.g., slots) within the conductive material, and having a lattice radiating array structure of radiating unit cell elements mounted proximate the transmission lines. The feed distribution module includes a coupling module for providing an input signal to the transmission lines, or a portion of the transmission lines. The present examples illustrate the flexibility and robust design of the present disclosure in antenna and radar design. In some examples, the coupling module is a power divider structure that divides the signal among the plurality of transmission lines, where the power may be distributed equally among the "N" number of transmission lines or may be distributed according to another scheme, where the "N" number of transmission lines do not all receive a same signal strength.

The feed distribution module may include impedance matching elements coupled to the transmission array structure (e.g., coupled to at least two transmission lines). In some examples, each impedance matching element incorporates a reactance control element to modify a capacitance of the transmission lines or unit cell elements of the radiating array structure. The impedance matching element may be configured to match the input signal parameters with the radiating unit cell elements, and therefore, there are a variety of configurations and locations for the impedance matching element, which may include a plurality of components.

In an example, the impedance matching element includes a directional coupler having an input port to each of adjacent transmission lines. The adjacent transmission lines and the impedance matching element form a super element, where the adjacent transmission line pair has a specific phase difference, such as a 90-degree phase difference with respect to each other.

As described in various examples of the present disclosure, a reactance control element is incorporated to adjust the effective reactance of a transmission line and/or a radiating element fed by a transmission line. Such a reactance control element may be a varactor diode having a bias voltage applied by an antenna controller. The varactor diode acts as a variable capacitor when a reverse bias voltage is applied. As used herein, the reverse bias voltage is also referred to herein as reactance control voltage or varactor voltage. The value of the reactance, which in this case is a capacitance, is a function of the reverse bias voltage value. By changing the reactance control voltage, the capacitance of the varactor diode is changed over a given range of values. Alternate examples may use alternate methods for changing the reactance, which may be electrically or mechanically controlled. In some examples of the present disclosure, a varactor diode may also be placed between conductive areas of a radiating unit cell element. With respect to the radiating unit cell element, changes in varactor voltage produce changes in the effective capacitance of the radiating element. The change in effective capacitance changes the behavior of the radiating unit cell element and in this way, the varactor may be considered as a tuning element for the radiating unit cell elements in beam formation.

The reactance control element enables control of the reactance of a fixed geometric transmission line. One or more reactance control elements may be placed within a transmission line. Similarly, reactance control elements may be placed within multiple transmission lines to achieve a desired result. The reactance control elements may have individual controls or may have a common control, such an antenna controller. In some examples, a modification to a first reactance control element is a function of a modification to a second reactance control element.

These examples support autonomous driving with improved sensor performance, all-weather/all-condition detection, advanced decision-making algorithms, and interaction with other sensors through sensor fusion. These configurations optimize the use of radar sensors, as radar is not inhibited by weather conditions in many applications, such as for self-driving cars. The ability to capture environmental information early aids control of a vehicle, allowing anticipation of hazards and changing conditions. The sensor performance is also enhanced with these structures, enabling long-range and short-range visibility to the controller. In an automotive application, short-range visibility is considered within thirty (30) meters of a vehicle, such as to detect a person in a crosswalk directly in front of the vehicle. And long-range visibility is considered to be 250 meters or more, such as to detect approaching cars on a highway. These examples provide automotive radars capable of reconstructing the world around them and are effectively a radar "digital eye", having true three-dimensional (3D) vision and capable of human-like interpretation of the world.

In some examples, a radar system steers a highly-directive RF beam that can accurately determine the location and speed of road objects. These examples are not prohibited by weather conditions or clutter in an environment. These examples provide performance similar to that available with synthetic aperture radar (SAR) capability. The examples of the present disclosure use radar to provide information for two-dimensional (2D) image capability as they measure range and azimuth angle, providing distance to an object and an azimuth angle identifying a projected location on a horizontal plane, respectively, without the use of traditional large antenna elements.

The examples of the present disclosure provide methods and apparatuses for radiating structures, such as for radar and cellular antennas, and provide enhanced phase shifting of the transmitted signal to achieve transmission in the autonomous vehicle range (which in the United States is approximately 77 Gigahertz (GHz) and has a 5 GHz range, specifically, 76 GHz to 81 GHz) while reducing the computational complexity of the system and increasing the transmission speed. The examples of the present disclosure accomplish these goals by taking advantage of the properties of hexagonal structures coupled with novel feed structures. In some examples, these goals are accomplished by taking advantage of the properties of MTM structures coupled with novel feed structures.

Metamaterials derive their unusual properties from structure rather than composition, and they possess exotic properties not usually found in nature. The metamaterial antennas may take any of a variety of forms, some of which are described herein for comprehension; however, this is not an exhaustive compilation of the possible examples of the present disclosure.

In the following description, numerous details are set forth in order to provide a more thorough description of the system. It will be apparent, however, to one skilled in the art, that the disclosed system may be practiced without these specific details. In the other instances, well known features have not been described in detail, so as not to unnecessarily obscure the system.

examples of the present disclosure may be described herein in terms of functional and/or logical components and various processing steps. It should be appreciated that such components may be realized by any number of hardware, software, and/or firmware components configured to perform the specified functions. For example, the present disclosure may employ various integrated circuit components (e.g., memory elements, digital signal processing elements, logic elements, look-up tables, or the like), which may carry out a variety of functions under the control of one or more processors, microprocessors, or other control devices. In addition, those skilled in the art will appreciate that examples of the present disclosure may be practiced in conjunction with other components, and that the systems described herein are merely examples that may be employed of the present disclosure.

For the sake of brevity, conventional techniques and components related to radiating structures, and other functional aspects of the system (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in one or more examples of the present disclosure.

FIG. 1 illustrates a system 9 having a radiating array structure 16 or device in accordance with various examples. System 9 is a "digital eye" with true three-dimensional (3D) vision and capable of a human-like interpretation of the world. The "digital eye" and human-like interpretation capabilities are provided by two main modules: a radiating structure 10 and an artificial intelligence (AI) module 5.

Radiating structure 10 is capable of radiating dynamically controllable and highly-directive RF beams. Radiating structure 10 has a feed distribution module 12, a transmission array structure 14, and the radiating array structure 16. Radiating structure is communicatively coupled (e.g., using digital or analog signals) via a communication bus 11 to an antenna controller 6, a central processing unit 2, and a transceiver 4. A transmission signal controller 7 generates a transmission signal, which is defined by modulation and frequency. The transmission signal is provided by the transmission signal controller 7 via the transceiver 4 to the radiating structure 10 through circuitry, a coaxial cable, a wave guide, a communication bus 11, and/or other type signal feed connector. The transmission signal then propagates through the feed distribution module 12 to the transmission array structure 14 and then to radiating array structure 16 for transmission through the air as a radio frequency ("RF") beam. A variety of signals may be provided to the radiating structure 10 for transmission, from the transmission signal controller 7 through transceiver 4.

In an example application, the radiating structure 10 can be implemented in a radar sensor for use in a driver-assisted or autonomous vehicle. The transmission signal may be a Frequency Modulated Continuous Wave ("FMCW") signal, which is used for radar sensor applications as the transmitted signal is modulated in frequency, or phase. The FMCW signal enables a radar to measure range to a target by measuring timing and/or phase differences in phase and/or frequency between the transmitted signal and the received or reflected signal. Within FMCW formats, there are a variety of modulation patterns that may be used, including triangular, sawtooth, rectangular and so forth, each having advantages, challenges, and application for various purposes. For example, sawtooth modulation may be selected for use when detection involves large distances to a target, i.e., long range. In some examples, the shape of the waveform provides speed and velocity information based on the Doppler shift between signals. The received Doppler information may be stored in a memory storage 8. This information enables construction of a range-Doppler map to indicate a location and movement of a detected object. As used herein, a target is any object detected by the radar, but may also refer to a specific type of object, e.g., a vehicle, a person, an animal, a road sign, and so on.

In another example application, the radiating structure 10 is applicable in a wireless communication or cellular system, implementing user tracking from a base station, fixed wireless location, and so on, or function as a wireless relay to provide expanded coverage to users in a wireless network. The transmission signal in cellular communications is a coded signal, such as a cellular modulated Orthogonal Frequency Division Multiplexed ("OFDM") signal. The transmission signal controller 7 may generate a cellular modulated OFDM signal and, for some communication systems, the transmission signal controller 7 may act as an interface, translator, modulation controller, or otherwise as required. Other types of signals may also be used with radiating structure 10, depending on the desired application.

Transceiver 4 coupled to the radiating structure 10 prepares a transmission signal for transmission, where the transmission signal is defined by modulation and frequency. The transmission signal is provided to the radiating structure 10 through a coaxial cable or other connector and/or communication bus 11 and propagates through the radiating structure 10 for transmission through the air via RF beams at a given phase and direction. The RF beams and their parameters (e.g., beamwidth, phase, azimuth and elevation angles, etc.) are controlled by an antenna controller 6, such as at the direction of AI module 5.

The RF beams reflect off of targets and the RF reflections are received by the transceiver 4. The received radar data may be stored in memory storage 8. Radar data from the received RF beams is provided to the AI module 5 for target detection and identification. The radar data may be organized in sets of Range-Doppler ("RD") map information, corresponding to 4D information that is determined by each RF beam radiated off of targets, such as azimuthal angles, elevation'angles, range, and velocity. The RD maps may be extracted from FMCW radar pulses and contain both noise and systematic artifacts from Fourier analysis of the pulses. The AI module 5 may control further operation of the radiating structure 10 by, for example, providing beam parameters for the next RF beams to be radiated from the radiating structure 10.

In operation, the antenna controller 6 is responsible for directing the radiating structure 10 to generate RF beams with determined parameters such as beamwidth, transmit angle, transmit direction, power, and so on. The antenna controller 6 may, for example, determine the parameters at the direction of the AI module 5, which may at any given time want to focus on a specific area of a field of view (FoV) upon identifying targets of interest in a vehicle's path or surrounding environment. The antenna controller 6 determines the direction, power, and other parameters of the beams and controls the radiating structure 10 to achieve beam steering in various directions. The antenna controller 6 also determines a voltage matrix to apply to reactance control elements 15 and/or impedance matching elements 13 in radiating structure 10 to achieve a given phase shift. In various examples, the radiating structure 10 is adapted to transmit a directional beam through active control of the reactance parameters of individual radiating unit cell elements 20 in radiating array structure 16. The radiating structure 10 radiates RF beams having the determined parameters. The RF beams are reflected off of targets (e.g., in a 360 degrees (°) FoV) and are received by the transceiver 4.

In various examples described herein, the use of system 9 in an autonomous driving vehicle provides a reliable way to detect targets in difficult weather conditions. For example, historically a driver will slow down dramatically in thick fog, as the driving speed decreases with decreases in visibility. On a highway in Europe, for example, where the speed limit is 115 kilometers per hour (km/h), a driver may need to slow down to 40 km/h when visibility is poor. Using the radar system 9, the driver (or driverless vehicle) may maintain a maximum safe speed without regard to the weather conditions. Even if other drivers slow down, a vehicle enabled with the system 9 will be able to detect those slow-moving vehicles and obstacles in the way and avoid/navigate around them.

Additionally, in highly congested areas, it is necessary for an autonomous vehicle to detect objects in sufficient time to react and take action. The examples provided herein for system 9 increase the sweep time of a radar signal so as to detect any echoes in time to react. In rural areas and other areas with few obstacles during travel, the system 9 adjusts the focus of the beam to a larger beamwidth, thereby enabling a faster scan of areas where there are fewer echoes. The AI module 5 may detect this situation by evaluating the number of echoes received within a given time period and making beam size adjustments accordingly. Once a target is detected, the AI module 5 determines how to adjust the beam focus. This is achieved by changing the specific configurations and conditions of the radiating structure 10.

All of these detection scenarios, analysis and reactions may be stored in the AI module 5 (and/or in the memory storage 8) and used for later analysis or simplified reactions. For example, if there is an increase in the number of echoes received at a given time of day or on a specific highway, that information is fed into the antenna controller 6 to assist in proactive preparation and configuration of the radiating structure 10.

The examples of the present disclosure are described with respect to a radar system, where the radiating structure 10 is a transmission array-fed radiating array, where the signal radiates through slots (refer to slots 17 in FIG. 3) in the transmission lines (e.g., refer to transmission line 21 of FIG. 3) of the transmission array structure 14 to the radiating array structure 16 comprising unit cell elements 20 that radiate a directional signal. The radiating structure 10 includes individual unit cell elements 20, which may comprise an impedance matching element 13 and a reactance control element 15 (e.g., refer to FIG. 11, which shows each exemplary hexagonal shaped unit cell element 30 comprising reactance control element 15).

In some examples, reactance control element 15 includes a capacitance control mechanism controlled by antenna controller 6, which may be used to control the phase of a radiating transmission signal from the radiating array structure 16. In operation, the antenna controller 6 receives information from AI module 5, or other modules (e.g., an interface to sensor fusion 3 module, which provides information related to sensor data obtained from sensors, or the memory storage 8, which provides program information), in system 9 indicating a next radiation beam of a transmission signal, where a radiation beam may be specified by parameters such as beamwidth, transmit angle, transmit direction, power, and so forth. The antenna controller 6 determines a voltage matrix to apply to reactance control elements 15 and/or impedance matching elements 13 in the feed distribution module and/or in the radiating array structure 16 to achieve a given phase shift or other parameters.

In these examples, the transmission lines in the transmission array structure 14 and/or the unit cell elements 20 of the radiating structure 10 are adapted to transmit a directional beam without using digital beam forming methods, but rather through active control of the reactance parameters of the transmission lines of the transmission array structure 14 and/or the individual radiating unit cell elements 20 that make up the radiating array structure 16. In one example scenario, the voltages on the reactance control elements 15 are adjusted, such as by antenna controller 6.

In some examples, the individual radiating unit cell elements 20 may be configured into subarrays that have specific characteristics. For these examples, transmission signals may be received by a portion, or subarray, of the radiating array structure 16. This configuration means that the subarray may be treated as a single unit, and all the reactance control devices are adjusted similarly. In another scenario, the subarray is changed to include a different number of radiating unit cell elements 20, where the combination of radiating unit cell elements 20 in a subarray may be changed dynamically to adjust to conditions and operation of the system 9.

The radiating structure 10 is applicable to many applications, including radar and cellular antennas. The present examples consider application in autonomous vehicles as a sensor to detect objects in the environment of the car. Alternate examples may be used for wireless communications, medical equipment, sensing, monitoring, and so forth. Each application type incorporates designs and configurations of the elements, structures and modules described herein to accommodate their needs and goals.

As illustrated, the radiating structure 10 includes the radiating array structure 16, which is composed of individual radiating unit cell elements 20 as discussed herein. The radiating array structure 16 may take a variety of forms and is designed to operate in coordination with the transmission array structure 14, where the individual radiating unit cell elements 20 correspond to slots (e.g., refer to slots 17 of FIG. 3) within the transmission lines (e.g., refer to transmission line 21 of FIG. 3) of the transmission array structure 14. As illustrated, the radiating array structure 16 is an 8×16 array of unit cell elements 20, where each of the unit cell elements 20 has a uniform size and shape; however, some examples may incorporate different sizes, shapes, configurations, and array sizes. When a transmission signal is provided to the radiating structure 10, such as through a coaxial cable or other connector, the signal propagates through the feed distribution module 12 to the transmission array structure 14 and then, to the radiating array structure 16 for transmission through the air.

The impedance matching element 13 and the reactance control element 15 may be positioned within the architecture of the feed distribution module 12; one or both may be external to the feed distribution module 12 for manufacture or composition as an antenna or radar module. The impedance matching element 13 works in coordination with the reactance control element 15 to provide phase shifting of the radiating transmission signal(s) from the radiating array structure 16. The examples of the present disclosure are a dramatic contrast to the traditional complex systems incorporating multiple antennas controlled by a digital beam forming network. The examples of the present disclosure increase the speed and flexibility of conventional systems, while reducing the footprint and expanding performance.

Figure 2:
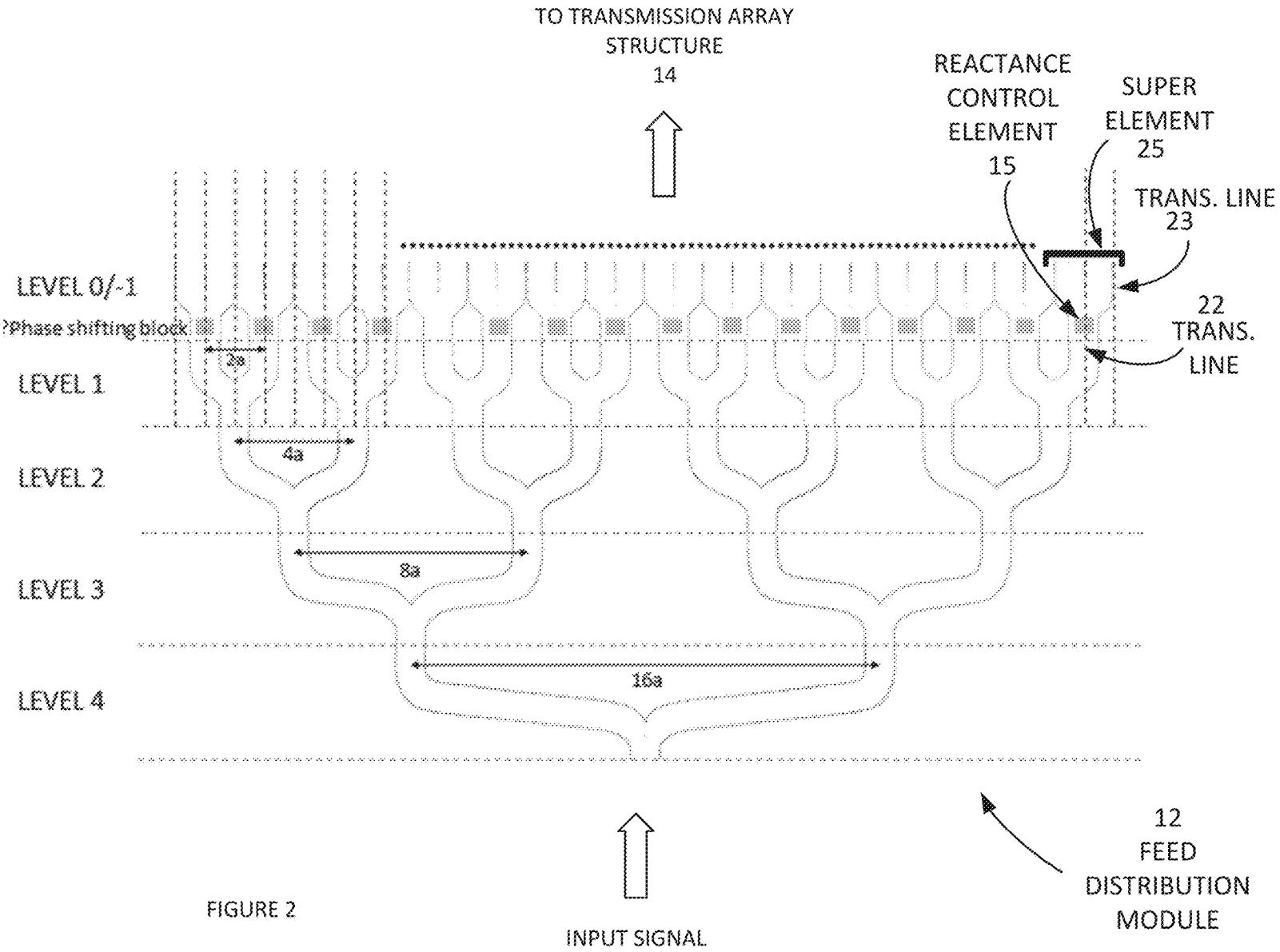
FIG. 2 illustrates a feed distribution module for a transmission array structure, such as for a radiating array structure, according to examples of the present disclosure.

FIG. 2 illustrates a perspective view of one example of feed distribution module 12 coupled to the transmission array structure 14, which feeds the radiating array structure 16. The feed distribution module 12 extends and couples to the transmission array structure 14. The radiating array structure 16 of this example is configured as a lattice of unit cell elements 20 (refer to FIG. 1). The unit cell elements 20 are metamaterial (MTM) artificially engineered conductive structures that act to radiate and/or receive signals (e.g., transmission signals). The lattice structure of the radiating array structure 16 is positioned proximate the transmission array structure 14 such that the signals fed into the transmission lines of the transmission array structure 14 are received at the lattice of unit cell elements 20 of the radiating array structure 16.

In particular, FIG. 2 illustrates a feed distribution module 12, which may be a power divider circuit (e.g., a coupling module). The input signal (e.g., a transmission signal) is fed in through the various paths. It should be noted that this configuration is an example and is not meant to be limiting. Each of the division points of the paths of the feed distribution module 12 belongs to a given level of division (e.g., LEVELS 0/−1, 2, 3, and 4). The feed distribution module 12 receives the input signal, which propagates through the paths to the transmission array structure 14. The size of the paths may be configured to achieve a desired transmission and/or radiation result. In the present example, path 22 (also referred to as transmission line 22) of LEVEL 1, includes a reactance control element 15, which changes the reactance of the path (also referred to as a transmission line), thereby resulting in a change to the signal propagating through that path. The reactance control element 15 is shown to be incorporated into transmission line 22, but may be coupled to the transmission line in a variety of different ways. As illustrated, the other paths (i.e. transmission lines) of LEVEL 1 have reactance control elements 15 that may be the same as reactance control element 15.

The transmission lines 22 and 23 are formed in the substrate of the transmission array structure 14. Transmission line 23 is a part of super element 25 that includes two transmission lines, namely transmission lines 22 and 23. The reactance control element 15 is configured on a microstrip within the structure of transmission line 22, and is illustrated in detail in FIGS. 3 and 4. Note that the placement of the reactance control element 15 may be positioned between transmission lines 22 and 23, or may be positioned otherwise within the transmission lines leading up to super element 25.

Figure 3:
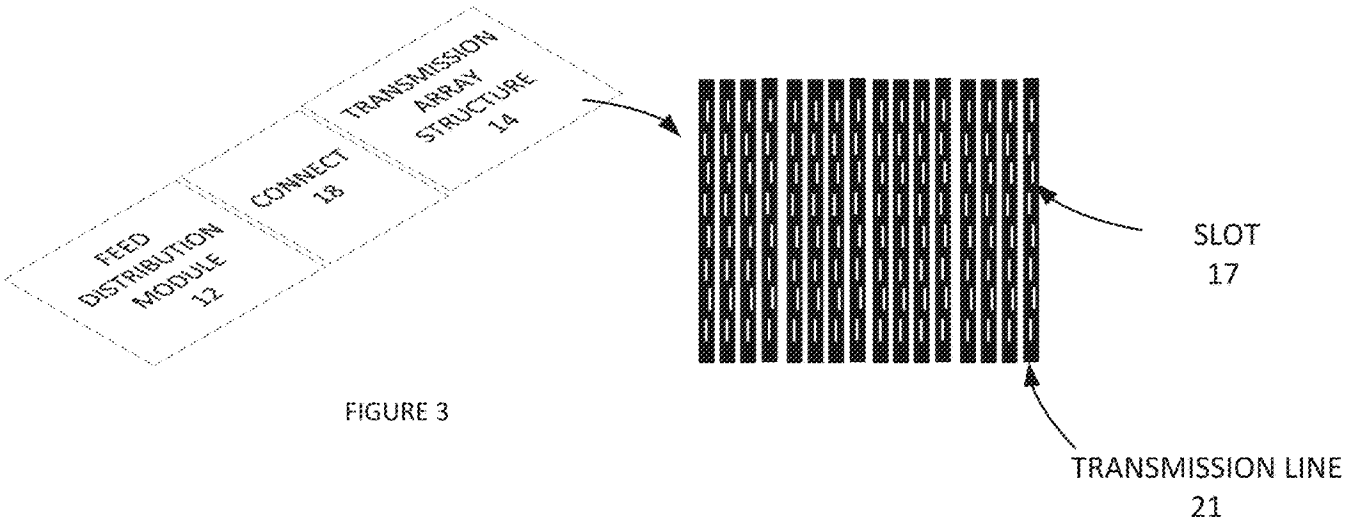
FIG. 3 illustrates a configuration of a feed distribution module and a transmission array structure, according to examples of the present disclosure.

FIG. 3 illustrates the layout of the feed distribution module 12 as proximate the transmission array structure 14, having a connection 18 there between. The transmission array structure 14 is composed of a plurality of transmission lines 21, which form super elements (SEs). In this configuration, a reactance control element 15 may be introduced into a transmission line (TL) forming a super element (SE). A super element may be a single transmission line 21 or a pair of transmission lines 21 that are controlled together (e.g., refer to SE 25 of FIG. 2, which comprises TL 22 and TL 23). A reactance control element 15 adjusts the reactance of the transmission line 21 so as to change the behavior of a signal that propagates through the transmission line 21. As feed distribution module 12 includes multiple path divisions, these end on SEs formed by transmission lines, each having a plurality of feed slots 17 that enable the transmission signal to propagate to the unit cell elements 20 of the radiating array structure 16 (refer to FIG. 1). The radiating array structure 16 is positioned proximate the transmission array structure 14 so that signals passing through slots 17 of a SE are received at the unit cell elements 20 of the radiating array structure 16, which radiates the signals.

Figure 4:
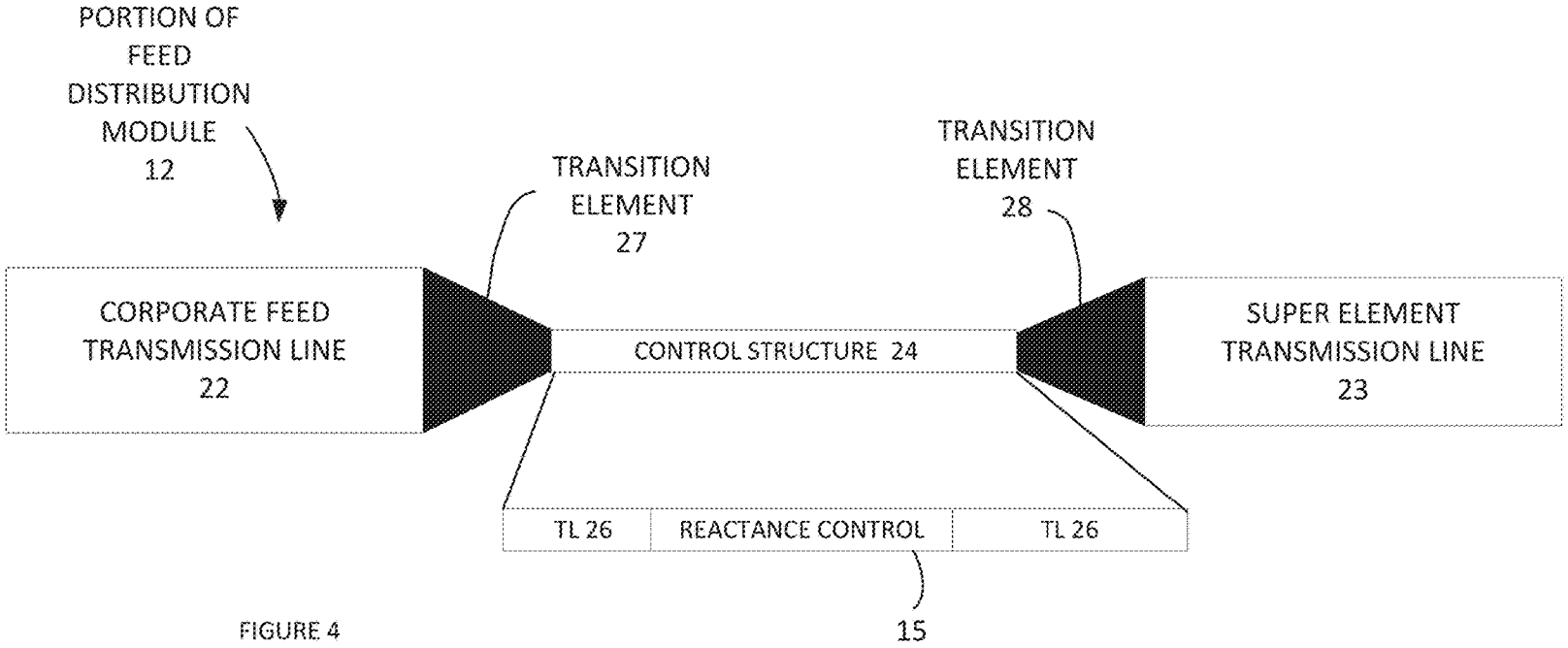
FIG. 4 illustrates a control structure for reactance control in a feed distribution module as in FIG. 3, according to examples of the present disclosure.

FIG. 4 illustrates a control structure 24 positioned within a path from transmission line 22 (referred to as corporate feed transmission line (TL) 22) to transmission line 23 (referred to as super element (SE) transmission line (TL) 23). The control structure 24 provides reactance control of the SE 25 (refer to FIG. 2), which is used to control the behavior of the SE TL 23. A change in behavior may be used to change the phase of a signal propagated through SE TL 23. When combined with other SEs, each having a specifically controlled phase, the system is able to generate a directed beamform from the radiating array structure 16. The control structure 24 has a reactance control element 15 formed on a TL 26. The TL 26 may be a microstrip, a strip line, or any other type of transmission line determined by the target use and application.

Transition elements 27 and 28 couple the TL 26 to the corporate feed TL 22 and the SE TL 23, respectively. In the present example, the corporate feed TL 22 and the SE TL 23 are both substrate integrated transmission lines, and the TL 26 is a microstrip. Other combinations and transmission line structures may also be used.

Figure 5:
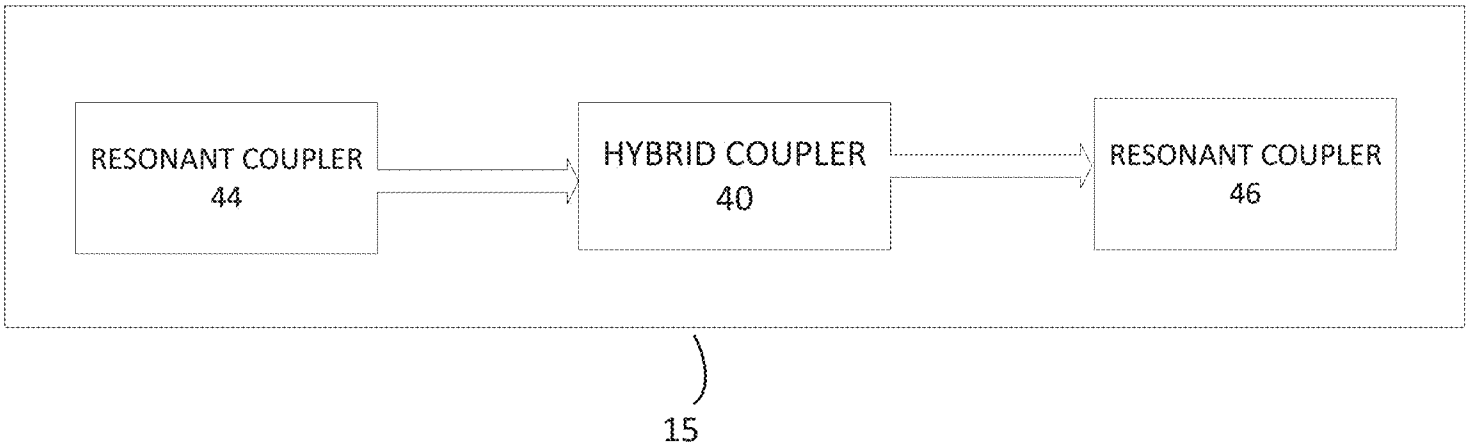
FIG. 5 illustrates a reactance control element as in the control structure of FIG. 4, according to examples of the present disclosure.

The reactance control element 15 is further detailed in FIG. 5, having a resonant coupler 44 coupled to a hybrid coupler 40, which is further coupled to another resonant coupler 46. The resonant couplers 44, 46 isolate the transmission signal propagating through the radiating structure 10 from control signals (e.g., reactance control signals) and other spurious signals that may be present in the radiating structure 10. The resonant couplers 44 and 46 in FIG. 5 may be of a different design of resonant coupler from one another. The hybrid coupler 40 comprises one or more varactor circuits as illustrated in FIG. 6.

Figure 6:
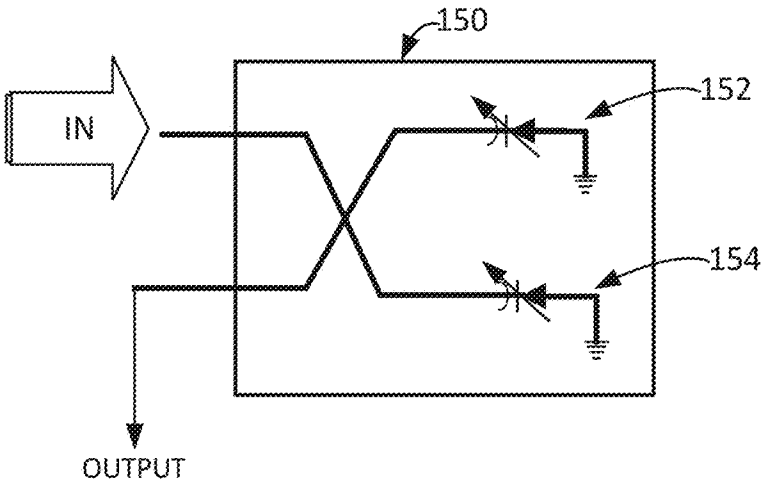
FIG. 6 illustrates a hybrid coupler, according to examples of the present disclosure.

Referring to FIG. 6, a hybrid coupler 150 receives an input transmission signal from, for example, resonant coupler 44 (refer to FIG. 5). The input (IN) is coupled as illustrated, where multiple variable capacitors 152, 154 are provided, each connected to ground. The hybrid coupler 150 is designed to have a phase difference of 90 degrees between the variable capacitors, or varactors, 152 and 154. The hybrid coupler 150 in the present example is a quadrature coupler and is integrated into the TL 26 to alter the capacitance of the path from TL 22 to TL 23.

Figure 7:
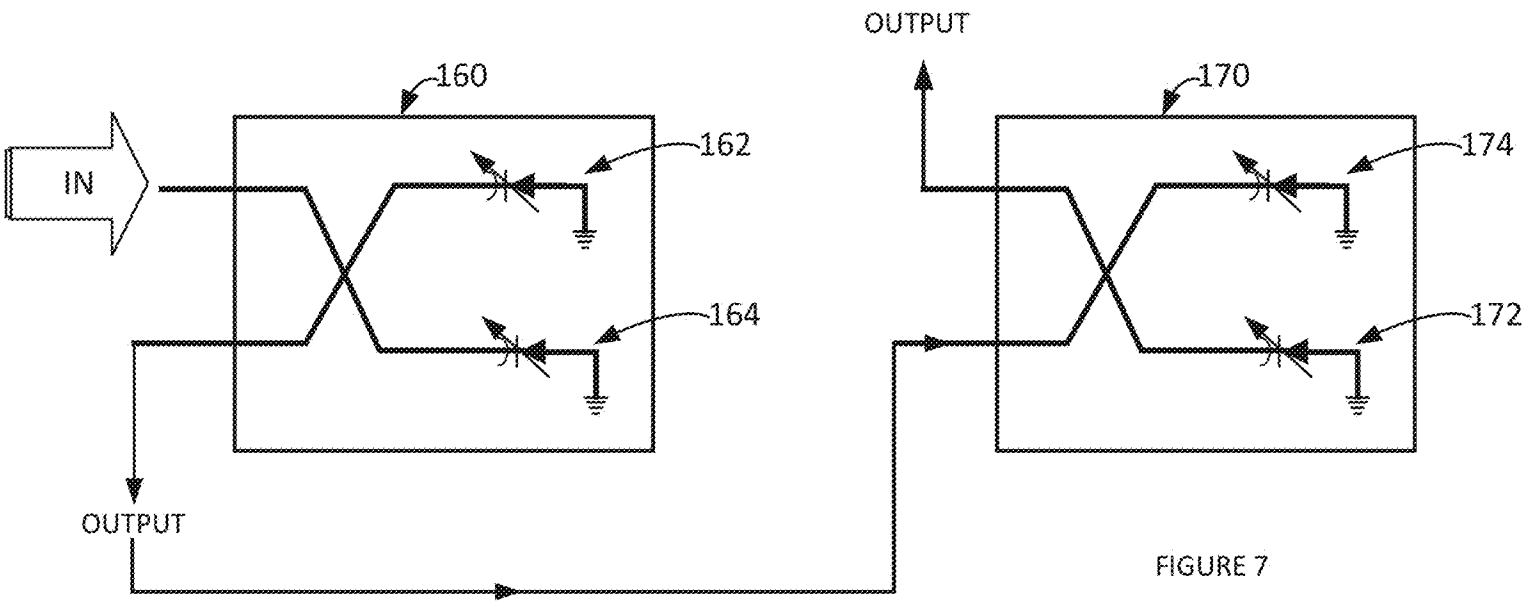
FIG. 7 illustrates a hybrid coupler circuit, according to examples of the present disclosure.

In some examples, multiple hybrid couplers may be integrated as a series of couplers. FIG. 7 illustrates such a configuration, where the output of a first hybrid coupler 160 is provided as an input to the next hybrid coupler 170. The series of hybrid couplers may continue in this way for any number of successive reactance changes. The number of stages is a function of the variable capacitor characteristics. In the present example, the components of hybrid coupler 160 and 170 are similar to those of hybrid coupler 150, wherein varactors 162 and 172 are similar to varactor 152, and varactors 164 and 174 are similar to varactor 154. Two hybrid couplers 160, 170 are illustrated in series, however, alternate examples may incorporate any number of hybrid couplers to achieve a desired range of reactance changes. In some examples, the hybrid couplers in a series may include different types of couplers and/or different configurations.

Figure 8:
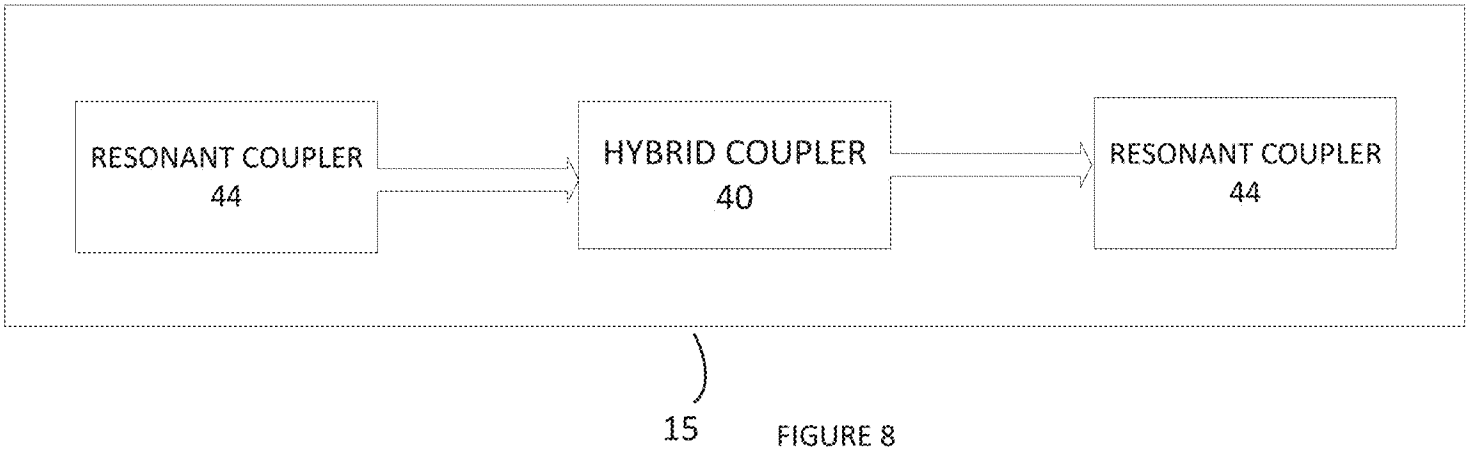
FIG. 8 illustrates a reactance control element as in the control structure of FIG. 4, according to examples of the present disclosure.
Figure 9:
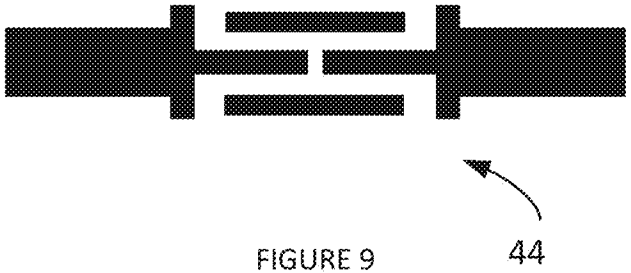
FIG. 9 illustrates a resonant coupler as in the reactance control element of FIG. 8, according to examples of the present disclosure.

FIG. 8 illustrates an example of the reactance control element 15 having similar resonant couplers 44 at each end of the TL 26. In this example, the resonant coupler 44 is an isolation device, having a symmetric structure (refer to FIG. 9, which shows an exemplary design for resonant coupler 44). The resonant coupler 44 acts to isolate the transmission signal from any control signals (e.g. reactance control signals) or artifacts of control signals. The resonant couplers 44 in FIG. 8 may both be of the same design of resonant coupler.

The hybrid coupler 40 provides a method for phase change and control of the transmission signal through the various transmission lines of the transmission array structure 14. The phase control of the signal through the transmission array structure 14 is used to beamform signals from the radiating array structure 16. The transmission lines (refer to transmission line 21 of FIG. 3) include discontinuity elements (refer to slots 17 of FIG. 3) that act similar to slot antenna elements. The transmission array structure 14 is positioned such that the discontinuity elements (e.g., slots 17) of the transmission array structure 14 correspond to specific unit cell elements 20 of the radiating array structure 16.

Figure 10:
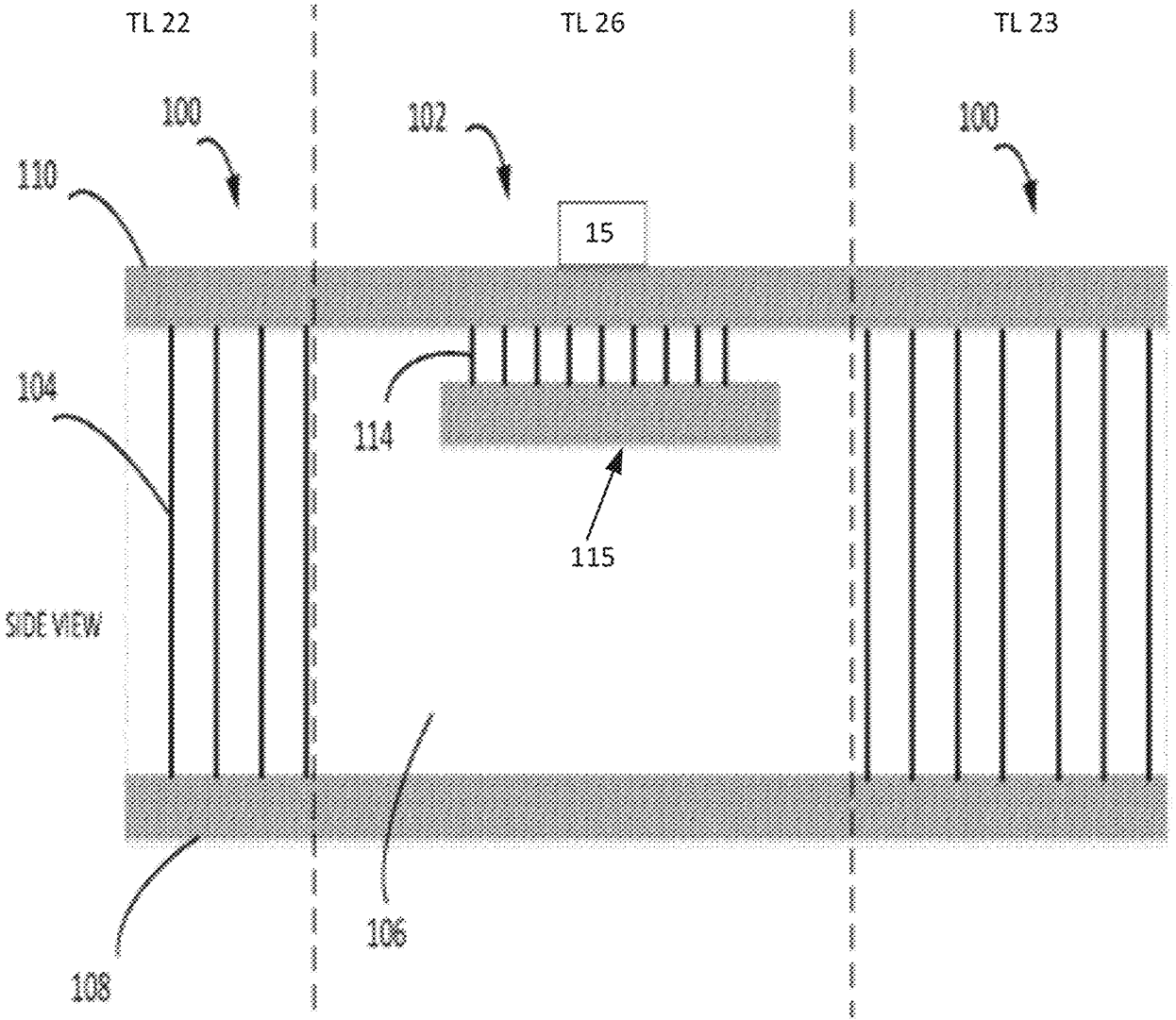
FIG. 10 illustrates a transmission array structure having a reactance control element as in the control structure of FIG. 4, according to examples of the present disclosure.

FIG. 10 illustrates a side view of a transmission line structure, having a first portion 100 and a second portion 102. The structure has a conductive reference layer 108, a top conductive layer 110, and a dielectric layer 106 sandwiched between the conductive layers 108, 110. The first portion 100 is a substrate integrated waveguide (SIW) having a plurality of vias 104 conductively coupling the conductive layers 108 and 110. The second portion 102 is configured to support a reactance control element 15.

The second portion 102 in the present example is a microstrip structure. Alternate examples may incorporate other structures, such as a strip line or other structure that supports the function of the reactance control element 15. In this example, the reactance control element 15 is a varactor diode controlled by a bias voltage. Portion 102 comprises an additional conductive layer 115, which is connected to the top conductive layer 110 via a plurality of vias 114.

Another portion 100 of the transmission line is provided on the opposite side of the portion 102. The transmission line may have any number of portions 102 configured within the transmission line. The portions 102 are provided as the reactance control elements 15 for the transmission lines (e.g., refer to transmission line 22 of FIG. 2) or for the unit cell elements 20. The number of reactance control elements 15 implemented is a function of the characteristic of the reactance control element 15 and the desired range of control for the unit cell elements 20.

Figure 11:
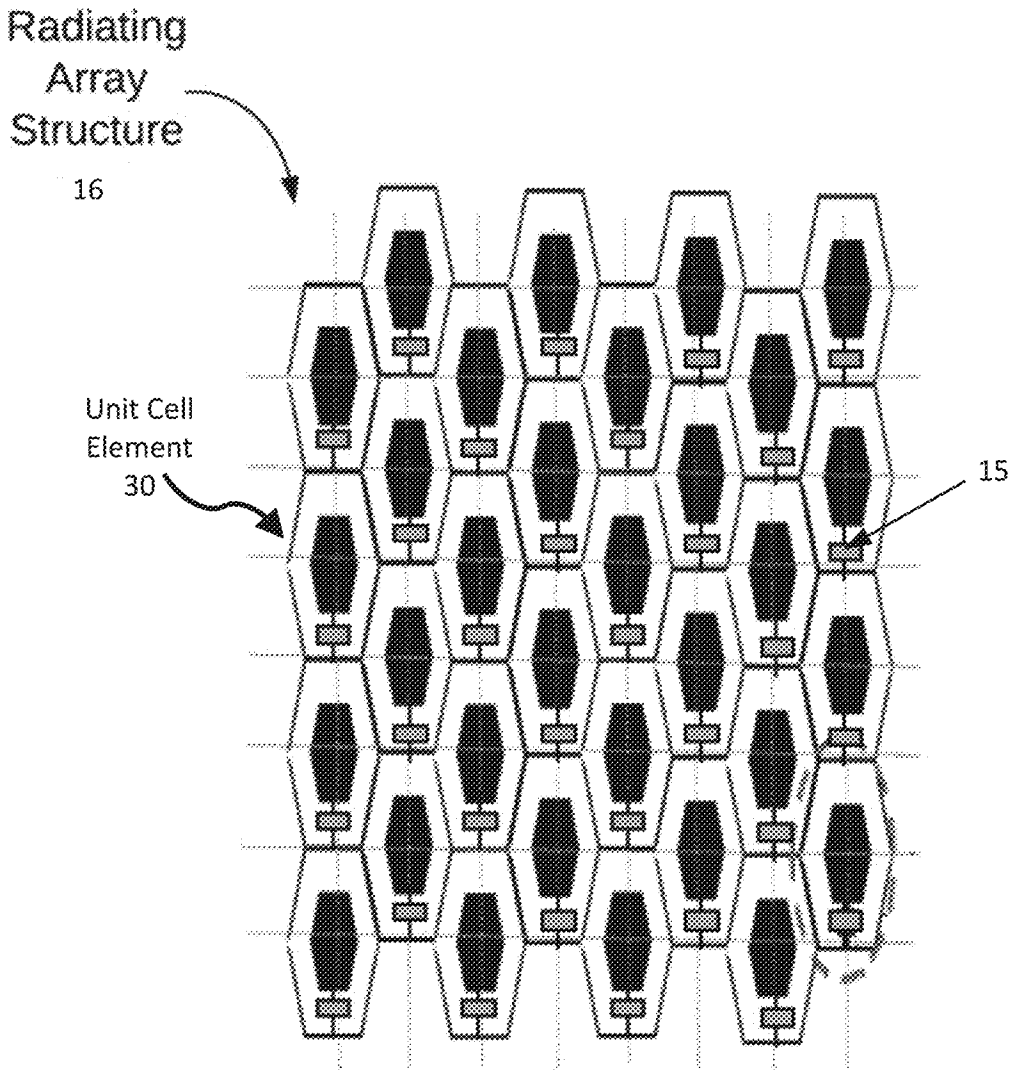
FIG. 11 illustrates a radiating array structure comprising hexagonal unit cell elements, according to examples of the present disclosure.

Referring to FIG. 11, the radiating array structure 16 may be made up of a lattice of repeating hexagonal unit cell elements 30. Each hexagonal unit cell element 30 is designed to radiate at the transmission signal frequency, where each hexagonal unit cell element 30 is the same size and shape. The signal radiating from a given hexagonal unit cell element 30, or group of hexagonal unit cell elements 30, radiates at a specific phase that is controlled by a reactance control element 15, which may be a variable capacitive diode, or varactor. In such an example, the varactor changes a capacitive behavior of the radiating hexagonal unit cell element 30 to achieve a phase change or shift in the transmission signal. The varactor is controlled by antenna controller 6, which adjusts a voltage on the varactor to achieve the resultant capacitance change of the radiating hexagonal unit cell element 30. In FIG. 11, each hexagonal unit cell element 30 is shown to comprise a reactance control element 15. However, in other examples, some or none of the hexagonal unit cell elements 30 comprise a reactance control element 15.

Alternating shapes and configurations may be used in alternate examples to build a lattice array of radiating unit cell elements 20, 30 for the radiating array structure 16 as a function of design parameters and desired performance. Reactance control, or phase control, is then achieved through control of the parameters of transmission lines 21 and/or radiating unit cell elements 20, 30.

The apparatus and structures of the present disclosure may be formed as conductive traces on a substrate having a dielectric layer. The transmission array structure 14 provides the transmission signal energy to each of the unit cell elements 20, 30 by way of multiple parallel transmission paths (also referred to as transmission lines). While the same signal is provided to each unit cell element 20, 30, the antenna controller 6 controls the phase of each transmission line 21 and/or each unit cell element 20, 30 by a variable reactance control element 15. For example, a varactor control may be a capacitance control array, wherein each of a set of varactor diodes is controlled by an individual reverse bias voltage resulting in an effective capacitance change to at least one individual unit cell element 20, 30. The varactor then controls the phase of the transmission of each unit cell element 20, 30, and together the entire antenna radiating array structure 16 transmits an electromagnetic radiation beam. Control of reverse bias voltages or other controls of the capacitance reactance control element 15 may incorporate a digital-to-analog converter (DAC) device. The incorporation of a resonant coupler 44, 46 allows separation of the control signal (e.g., reactance control signal) or other signals that are used in operation of the radiating structure 10.

The examples of the present disclosure provide methods and apparatuses for radiating a transmission signal, such as for radar or wireless communications, using a lattice array of radiating unit cell elements 20, 30 along with a transmission array structure 14 and a feed distribution module 12. The feed distribution module 12 distributes the transmission signal throughout the transmission array structure 14, where the transmission signal propagates along the rows of transmission lines 21 of the transmission array structure 14, and discontinuities (e.g. slots 17) are positioned along each row (e.g., each transmission line 21). The discontinuities are positioned to correspond to radiating unit cell elements 20, 30 of the lattice radiating array structure 16. The radiating unit cell elements 20, 30 are coupled to an antenna controller 6 that applies voltages to the radiating unit cell elements 20, 30 to change the electromagnetic characteristics. This change may be an effective change in capacitance that acts to shift the phase of the transmission signal. By phase shifting the transmission signal from individual radiating unit cell elements 20, 30, the system 9 forms a specific beam in a specific direction. The resonant coupler 44, 46 keeps the transmission signal isolated and avoids any performance degradation from any of the processing. In some examples, the radiating unit cell elements 20, 30 are MTM elements. These systems are applicable to radar for autonomous vehicles, drones, and communication systems. The radiating unit cell elements 20, 30 may comprise a hexagonal shape (refer to hexagonal unit cell elements 30 in FIG. 10), which is conducive to dense configurations optimizing the use of space and reducing the size of a conventional antenna.

Although particular examples have been shown and described, it should be understood that the above discussion is not intended to limit the scope of these examples. While examples and variations of the many aspects of the disclosure have been disclosed and described herein, such disclosure is provided for purposes of explanation and illustration only. Thus, various changes and modifications may be made without departing from the scope of the claims.

Where methods described above indicate certain events occurring in certain order, those of ordinary skill in the art having the benefit of this disclosure would recognize that the ordering may be modified and that such modifications are in accordance with the variations of the present disclosure. Additionally, parts of methods may be performed concurrently in a parallel process when possible, as well as performed sequentially. In addition, more steps or less steps of the methods may be performed.

Accordingly, examples are intended to exemplify alternatives, modifications, and equivalents that may fall within the scope of the claims.

Although certain illustrative examples and methods have been disclosed herein, it can be apparent from the foregoing disclosure to those skilled in the art that variations and modifications of such examples and methods can be made without departing from the true spirit and scope of this disclosure. Many other examples exist, each differing from others in matters of detail only. Accordingly, it is intended that this disclosure be limited only to the extent required by the appended claims and the rules and principles of applicable law.

We claim:

1. A radiating structure comprising: a plurality of transmission lines, wherein each of the plurality of transmission lines comprises a plurality of slots; at least one reactance control element, which is on a microstrip of one of the plurality of transmission lines and is coupled to at least one of plurality of transmission lines, configured to change a reactance of the at least one of the plurality of transmission lines, and controlled by at least one reactance control signal; at least one resonant coupler configured to isolate at least one transmission signal from the at least one reactance control signal; and a plurality of unit cell elements configured to radiate the at least one transmission signal, wherein the plurality of unit cell elements are mounted proximate the plurality of slots of the plurality of transmission lines such that each of the slots is associated with one of the plurality of unit cell elements.

2. The radiating structure of claim 1, further comprising at least one impedance matching element configured to match an impedance of at least two of the plurality of transmission lines.

3. The radiating structure of claim 1, wherein the plurality of transmission lines are structured to comprise a plurality of levels.

4. The radiating structure of claim 1, wherein each of the plurality of unit cell elements comprises a metamaterial (MTM).

5. The radiating structure of claim 1, wherein each of the at least one reactance control element comprises at least one hybrid coupler.

6. The radiating structure of claim 5, wherein the at least one hybrid coupler comprises a plurality of varactors.

7. The radiating structure of claim 1, wherein each of the plurality of unit cell elements is hexagonal in shape.

8. The radiating structure of claim 1, wherein the at least one reactance control element is coupled to at least one of the plurality of transmission lines via at least one transition element.

9. The radiating structure of claim 1, wherein the at least one reactance control element comprises at the least one of the resonant couplers.

10. The radiating structure of claim 1, wherein the at least one of the transmission signals is a frequency modulated continuous wave (FMCW) signal.

11. The radiating structure of claim 10, wherein the FMCW signal comprises one of a triangular modulation pattern, a sawtooth modulation pattern, or a rectangular modulation pattern.

12. The radiating structure of claim 1, wherein the at least one of the transmission signals is an orthogonal frequency division multiple (OFDM) signal.

13. The radiating structure of claim 1, wherein at least a portion of the plurality of unit cell elements forms a subarray.

14. A method for operating a radiating structure, the method comprising: transmitting, by a plurality of transmission lines, at least one transmission signal, wherein each of the plurality of transmission lines comprises a plurality of slots; changing, by at least one reactance control element controlled by at least one reactance control signal, a reactance of the at least one of the plurality of transmission lines to change a phase of the at least one transmission signal within the at least one of the plurality of transmission lines, wherein the at least one of the reactance control elements is on a microstrip of one of the plurality of transmission lines; isolating, by at least one resonant coupler, the at least one transmission signal from the at least one reactance control signal; and radiating, by a plurality of unit cell elements, the at least one transmission signal, wherein the plurality of unit cell elements are mounted proximate the slots of the plurality of transmission lines such that the at least one transmission signal radiates from the plurality of transmission lines to the unit cell elements via the slots of the plurality of transmission lines.

15. The method of claim 14, wherein each of the reactance control element(s) comprises at least one hybrid coupler.

16. The method of claim 14, wherein each hybrid coupler comprises a plurality of varactors.

* * * * *